United States Patent [19]

Schultes et al.

[11] Patent Number: 4,781,051

[45] Date of Patent: Nov. 1, 1988

[54] ROLLING MILL STAND WITH AXIALLY SHIFTABLE ROLLS

[75] Inventors: Tilmann Schultes, Solingen; Gerd Beisemann, Düsseldorf, both of Fed. Rep. of Germany

[73] Assignee: SMS Schloemann-Siemag Aktiengesellschaft, Dusseldorf, Fed. Rep. of Germany

[21] Appl. No.: 920,076

[22] Filed: Oct. 16, 1986

[51] Int. Cl.[4] ..... B21B 27/02; B21B 31/18; B21B 29/00

[52] U.S. Cl. ..... 72/247; 29/122; 72/199; 72/241

[58] Field of Search ..... 72/247, 245, 243, 241, 72/199, 365, 366; 29/122

[56] References Cited

U.S. PATENT DOCUMENTS

| | | | |
|---|---|---|---|
| 3,593,556 | 7/1971 | Blain | 72/245 X |
| 3,733,878 | 5/1973 | Anderson et al. | 72/241 |
| 3,857,268 | 12/1974 | Kajiwaka | 72/245 X |
| 4,202,192 | 5/1980 | Haneda et al. | 72/247 X |
| 4,440,012 | 4/1984 | Feldmann et al. | 72/247 X |
| 4,519,233 | 5/1985 | Feldmann et al. | 72/247 |
| 4,656,859 | 4/1987 | Ginzburg | 72/247 X |

FOREIGN PATENT DOCUMENTS

| | | | |
|---|---|---|---|
| 0049798 | 4/1982 | European Pat. Off. | 72/243 |
| 0072704 | 5/1982 | Japan | 72/241 |
| 0173001 | 10/1983 | Japan | 72/247 |

*Primary Examiner*—Robert L. Spruill
*Assistant Examiner*—Steven B. Katz
*Attorney, Agent, or Firm*—Herbert Dubno

[57] ABSTRACT

The rolling mill has two working rolls and at least two supporting rolls. At least both rolls of one roll pair are axially slidable opposing each other and each of the oppositely slidable rolls has a curved contour extending over its entire length which is convex over one longitudinal half segment and concave over the other longitudinal half segment. The contours of both rolls of these roll pairs complement each other continuously in one definite axial position. So that the occurence of increased load points and moreover as a result increased pressure at the contacting positions of the working rolls and the supporting rolls is prevented, the curved contour of the roll body at the free end of the concave longitudinal segment of the roll body extends to the body edges in an at least partially cylindrical longitudinal segment.

4 Claims, 4 Drawing Sheets

ROLLING MILL STAND WITH AXIALLY SHIFTABLE ROLLS

FIELD OF THE INVENTION

Our present invention relates to a rolling mill for rolling steel and, more particularly, to a rolling mill having axially shiftable bottle rolls.

BACKGROUND OF THE INVENTION

A rolling mill stand can have two working rolls each of which is supported directly or by an intermediate roll on a support or backup roll, the rolls of a roll pair, i.e. two complementarily functioning rolls, being axially shiftable in opposite directions and each of the rolls which are axially shiftable at least over a portion of the length of its roll body having a curved contour diverging from an axially parallel alignment, which extends over the entire length of the roll body, the contours of both rolls of the roll pairs complementing each other continuously exclusively in a definite axial position of the rolls. The curved-contour rolls, because they have convex or bulging portions adjacent concave portions, can be referred to as bottle rolls.

This rolling mill stand is described in German patent DE-PS No. 30 38 865. It has the advantage that the form of the roll gap and thus the rolled strip cross section may be modified exclusively by axially shifting the rolls provided with the curved contour and the roll force distribution changed without problems. The form of the roll gap and thus the cross section of the rolled strip being rolled can be influenced by even slight axial shifting of the rolls having the curved contour, and without particular concern for locating the shiftable rolls with respect to the rolled strip width.

Not only is it possible to use the features according to German Patent DE-PS No. 30 38 865 in rolling mills with supporting and/or intermediate rolls, but also they can easily be made a part of a dual rolling mill.

Additional improvements to the rolling mill stand of German Patent DE-PS No. 30 38 865 are provided in German Open Patent Application DE-OS No. 32 13 496. The rolls of several roll pairs of a roll stand have a fitting curved contour on their roll bodies and are axially shiftable opposing each other.

It is possible in a four-high rolling mill to provide both the working rolls and the backup rolls with a curved contour extending over the entire length of the roll body.

In a six-high rolling mill, the intermediate rolls can also have a curved contour extending over the entire length of the roll body.

However, it is also possible in these systems to use backup rolls which are cylindrical, that is whose contour is axially aligned and linear, while the working and intermediate rolls have a curved contour exending over their entire length.

Finally it is also possible in the prior art to provide the roll body of the working roll with a cylindrical contour over its entire length while the backup rolls are provided with curved shapes extending over their entire length.

In practice this kind of rolling mill has been shown to be able to attain an optimum rolled product in a particularly simple way. In using these rolling mills, particularly in a heavy rolling program, pressures between the contacting surfaces on the roll bodies of neighboring rolls under certain definite operating conditions can occur which lie in the critical range. Because the curved contour extends over the entire length of the roll body, an unsymmetrical load distribution occurs with linear load peaks at that end of the roll body which confronts the concave segment of the curved contour with its body edges.

The highest linear load peaks occur in the contacting gap between neighboring rolls during operation of the rolling mill in which a negative shift position of the rolls having the curved body contour relative to the longitudinal half having the concave contour is present and at the same time a positive bending for the roller concerned occurs, when also the bending force acting on the roll is unidirected to the curvature of the contour. Such operating conditions can lead particularly easily to damage to the roll bodies.

OBJECTS OF THE INVENTION

It is an object of our invention to provide an improved rolling mill in which linear load peaks of the aforedescribed type can be reduced in significance.

It is also an object of our invention to provide an improved rolling mill with shiftable rolls with none of the above mentioned disadvantages.

It is another object of our invention to provide an improved rolling mill in which a reduction of the linear load peaks at that roll which has a curved contour extending over the entire length of its roller body is attained.

SUMMARY OF THE INVENTION

These objects and others which will become more readily apparent hereinafter are attained in accordance with our invention in a rolling mill comprising two working rolls each of which is supported directly or by an intermediate roll on a backup roll, the rolls of a roll pair being axially shiftable in opposite directions and each of the rolls which are shiftable at least over a portion of the length of its roll body in a bottle roll having a curved contour diverging from an axially parallel alignment, the contours of both rolls of the roll pairs complementarily contacting each other continuously exclusively in one definite relative axial position of the rolls.

According to our invention the curved contour of the roll body at an end of a concave longitudinal segment of the roll body terminates inwardly of the body edge at a respective end and the rolls has from the termination of the concave segment to the end of the roll cylindrical longitudinal segment.

In contrast to the longitudinally curved roll body contour presently used in rolling mills stands, according to our invention, the concave longitudinal half of the roll body connected to the body edges has a slight diameter reduction and of course over a longitudinal region which matches the maximum axial displacement of the roll. Should this roll be provided with a displacement of about 100 mm relative to its neighboring roll in linear contact therewith, then the cylindrically longitudinal segment at the end of the concave longitudinal segment of the roll body should have a length of at least 100 mm.

In the type of rolling mill in which bottle rolls are in linear contact with adjacent rolls having a cylindrical body shape, the objects of our invention are attained by also providing a gentle conical tapering to the end of cylindrical roll body which is associated with the concave longitudinal segment of a roll having a curved contour.

Also in this case the conically tapered body contour for the cylindrical roll should extend over a longitudinal region of the roll body which is at least equal to the axial displacement between the neighboring rolls.

The tapering of the cylindrical roll can be so designed that it corresponds at least approximately to the course of the concave contour at the end of the roll neighboring it and coming into contact with it.

Of course, when two bottle rolls are in contact with one another, even where one is also in contact with a cylindrical roll, the two bottle rolls will have cylindrical end portions adjoining their concave portions while the cylindrical roll has the frustoconical end opposite the concave portion of the bottle roll with which it is in contact.

Both embodiments described eliminate the linear load peak problems described previously.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
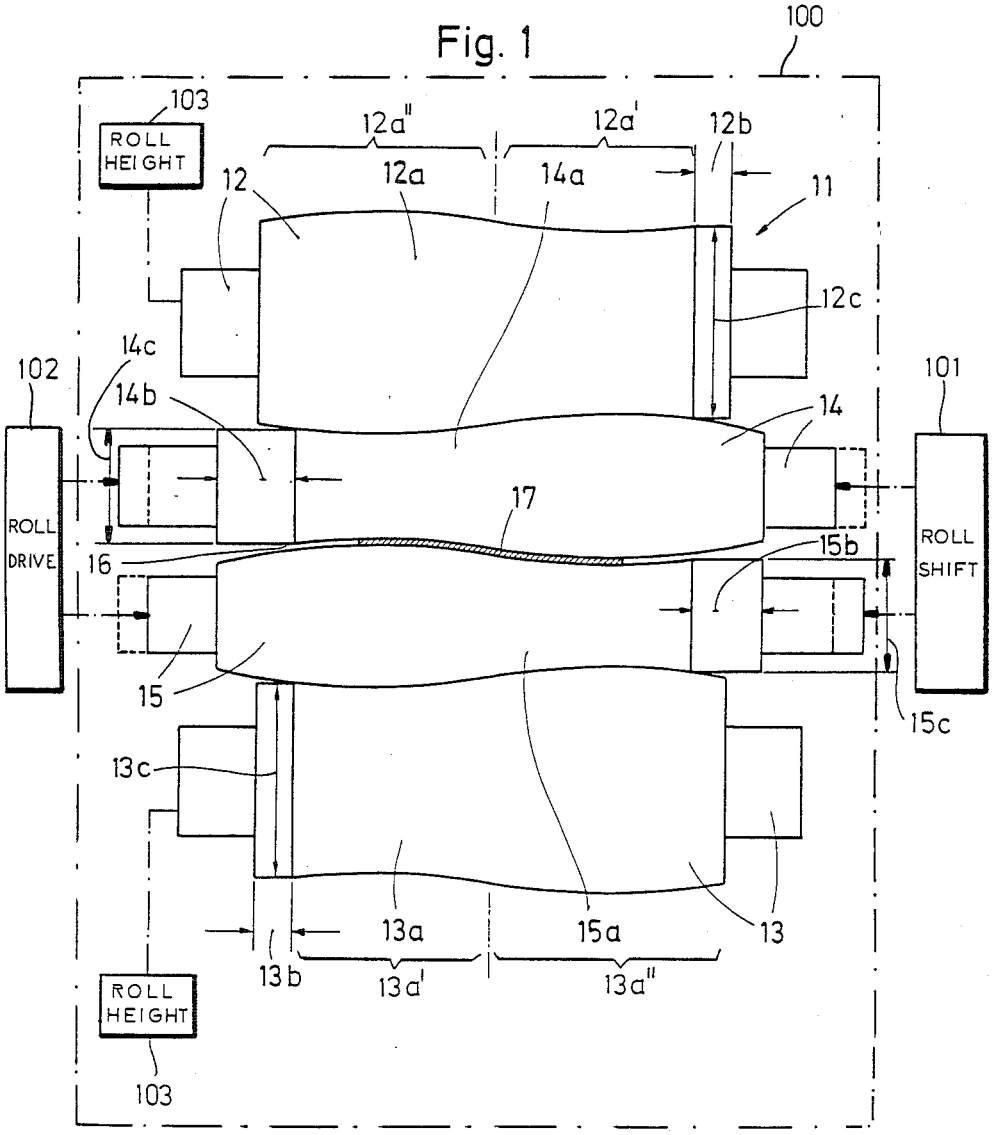
FIG. 1 is a schematic side elevational view of a four-high roll in a first embodiment of our invention as seen in the rolling direction.

In order to simplify the description only a roll stand with four rolls (FIG. 1) and a roll stand with six rolls (FIGS. 2 to 4) are shown in the drawing. The four-high rolling mill 11 according to FIG. 1 has a roll stand which comprises the backup roll pair 12 and 13 and the working roll pair 14 and 15. The support 100 for the rolls, the means 101 for axially shifting complementarily rolls of respective pairs in opposite directions, the roll drive 102 and the means 103 for urging the rolls together or apart have been represented schematically only in FIG. 1 but will of course be present in all of the roll stands.

The working roll pair 14,15 bounds a roll gap 16 for the rolled strip 17 whose height is determined in the usual way by the adjusting devices which are engaged with the structural members of the backup roll pair 12,13.

The roll bodies 12*a* and 13*a* of the backup bottle rolls 12 and 13 have a curved contour as seen along their longitudinal direction. In the case of the upper backup roll 12 the shape of the roll body 12*a* is convex on the left side of the roll 12 as seen in FIG. 1 while it is concave on the right side of the roll 12 as seen in FIG. 1.

It is the reverse for the lower backup roll 13, namely the roll body 13*a* is concave on the left but convex on the right in the drawing. Both longitudinal segments of the roll bodies 12*a* and 13*a* of the backup rolls 12 and 13 are defined by the same curve and it is apparent from FIG. 1 that both backup rolls 12 and 13 have an identical shape (their roll bodies 12*a* and 13*a* have the shape of the neck of a flask and are mounted in the roll stand rotated at an angle of 180° each with respect to the other).

It is apparent further from FIG. 1 that at the end of the longitudinal segment 12*a*' and 13*a*' of the roll bodies 12*a* and 13*a* having a concave shape there is a cylindrical longitudinal segment 12*b* and/or 13*b* extending longitudinally, which has a constant diameter 12*c* and/or 13*c*.

Also both working rolls 14 and 15 of the working roller pair have roll bodies 14*a* and 15*a* with a shape curved over their length which is designed to complement the shape of the roll bodies 12*a* and/or 13*a* of the adjacent backup rolls 12 and/or 13.

Accordingly the roll body 14*a* of the upper working roll 14 has a left segment which is concave and a right segment which is convex as seen in the drawing while the roll body 15*a* of the lower working roll 15 has a convex left half and a concave right half.

Also both working rolls 14 and 15 have according to FIG. 1 an identical—namely flask like—shape for their roll body 14*a* and 15*a* and they are mounted in the assembly in the roll stand turned about 180° relative to each other.

It is apparent further from the drawing that at the end of the concave longitudinal segment 14*a*' or 15*a*' of the roll body 14*a* or 15*a* there is a cylindrical longitudinal segment 14*b* or 15*b* extending longitudinally which has a constant diameter 14*c* or 15*c*.

At least one of the rolls of one of the roll pairs 12 and 13 and/or 14 and 15 of the four roll rolling mill 11 acccording to FIG. 1, advantageously the rolls of both roll pairs 12,13 and 14, 15 ar mounted by their stub shafts axially shiftable in the journal housings of the rolling mill. The device for axial shifting engages one of the roll stub shafts of each roll.

In the central axial position both the backup rolls 12 and 13 of the backup roll pair and also the working rolls 14 and 15 of the working roll pair have a roll gap 16 which has the same height over the entire body length as is shown in FIG. 1 although it runs along a slightly S-shaped course. The rolled strip 17 is rolled to the same thickness over its entire width.

The height of the roll gap 16 between both variably shaped roll bodies 14*a* and 15*a* of the working rolls 14 and 15 is dependent on the spacing between the axes of both working rolls 14 and 15 as well the varying radii.

Since both working rolls 14 and 15 can be shifted relative to each other axially and the backup rolls 12 and 13 can be shifted relative to each other and also with respect to the working rolls 14 and 15, the roll gap 16 can be changed in its cross sectional form to a considerable extent.

According to the intended adjustment either the roll pressure on the longitudinal edges of the rolled strip being rolled 17 can be raised or lowered.

It also allows the pressure distribution between the roll bodies 12*a* and 14*a* and 13*a* and 15*a* in close contact with each other to be very senstively influenced and thus a further optimization of the shape of the roll gap 16 is allowed. Because of the cylindrically extending longitudinal segments 12*b* and 13*b* at the ends of the concave longitudinal segment of the roll bodies 14*a* and 15*a* of the working rolls 14 and 15 it is guaranteed that the linear load peaks which can result with standard curved contours of the roll bodies in these cylindrical segments 12*b*, 13*b*, 14*b* and 15*b* under the operating conditions and working conditions of the rolling mill are effectively prevented.

Such linear load peaks hitherto could occur in axially repositioning of the roll bodies and lead to critical pressures in roll operation which causes undesirable deformation and damage to the roll bodies.

So that in every conceivable operational axial shift of the backup rolls 12 and 13 and the working rolls 14 and 15 in the four roll rolling mill 11 the occurence of critical linear load peaks is avoided, it is important that the length of the cylindrically extending longitudinal segments 12*b* and 13*b* on the roll bodies 12*a* and 13*a* of the backup rolls 12 and 13 and likewise also the length of the cylindrically extending longitudinal segments 14*b* and 15*b* correspond to the permissable axial displacement of the rolls from their base position. For example if an axial displacemnt of 100 mm is provided for each of the backup rolls 12 and 13 and the working rolls 14 and 15, then the cylindrical end regions 12*b*, 13*b* and/or 14*b*, 15*b* of their roll bodies 12*a*, 13*a* and/or 14*a*, 15*a* also has at least a length of 100 mm.

Figure 2:
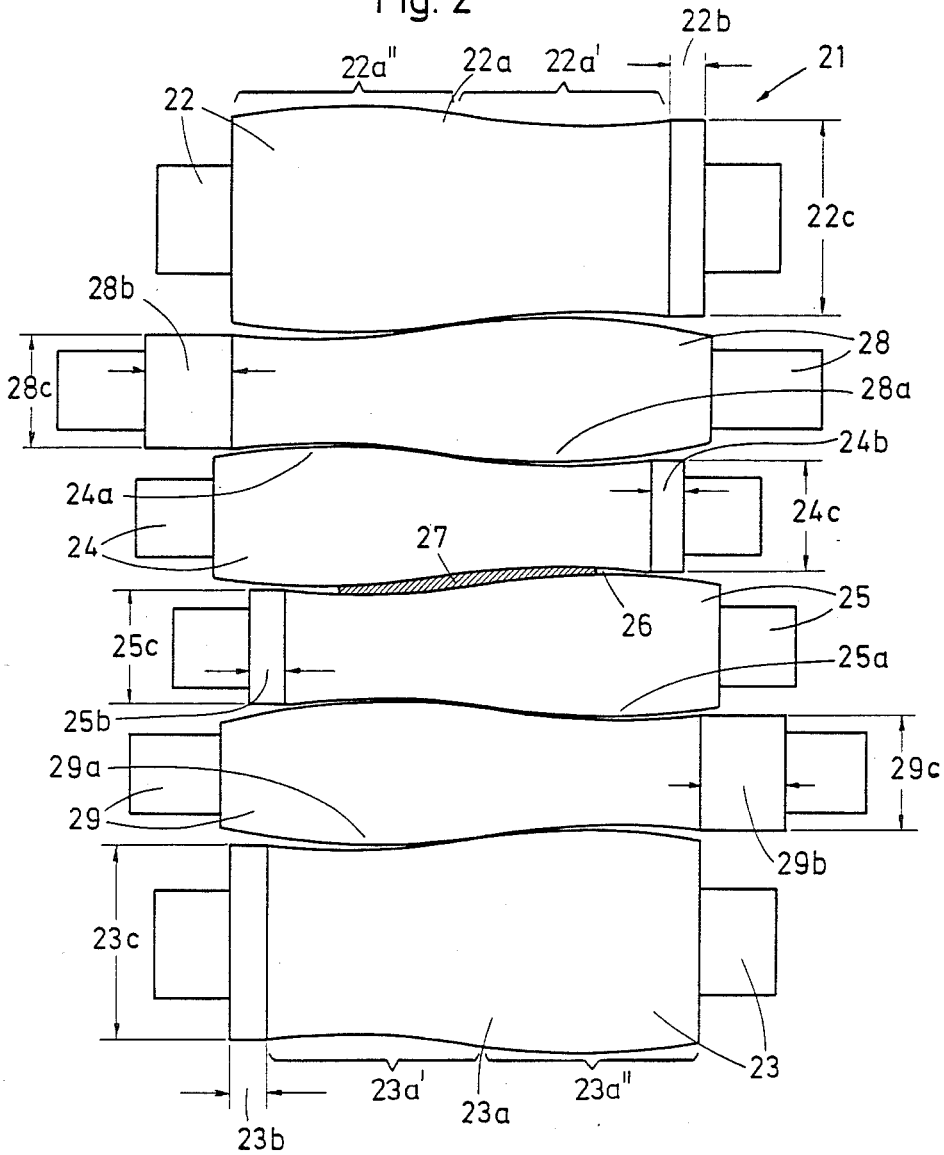
FIG. 2 is a schematic side elevational view of a six-high roll stand, according to our invention, as seen in the rolling direction.

The six-high rolling mill 21 according to FIG. 2 has the same basic structure as the four-high rolling mill 11 according to FIG. 1. Moreover both backup rolls 22 and 23 and both working rolls 24 and 25 are included in this six roll rolling mill 21. However two intermediate rolls 28 and 29 are also included. Also in this case both working rolls 24 and 25 bound the roll gap 26 for the rolled strip 27 to be worked.

Collectively the rolls of the six-high rolling mill 21 according to FIG. 2, that is, not only the backup bottle rolls 22 and 23 and the working bottle rolls 24 and 25 but also the intermediate bottle rolls 28 and 29 have roll bodies 28*a* and 29*a* with a curved shape in their longitudinal direction which have one convex longitudinal half and another concave longitudinal half (segment). The backup rolls 22 and 23 are provided with roll bodies 24*a* and 25*a*, while the intermediate rolls 28 and 29 have roll bodies 28*a* and 29*a*.

The curved shapes of the roll bodies 22*a*, 28*a*, 24*a* and/or 23*a*, 29*a*, 25*a* standing in close contact with each other are so formed with respect to each other that they completely complement each other in the central axial position of all the roll pairs, 22,23; 28,29; 24,25 of the six roll rolling mill 21 so that the roll gap 26 for the rolled strip 27, in spite of its S-shape cross sectional form over its entire length, has a uniform height over its entire length.

By relative axial shifting of the rolls of any roll pairs 22,23 and/or 24,25 and/or 28,29 with respect to each other and/or to the rolls of the other roll pairs the shape of the roll gap 26 can be sensitively influenced and of course by the presence of the intermediate roll pairs 28 and 29 and of course as sensitively as in the case of the four roll rolling mill 11 as shown in FIG. 1.

Also from FIG.2 it can be seen that the longitudinal segments 22*a*′,23*a*′,28*a*′,29*a*′,24*a*′ and 25*a*′ of the roll bodies 22*a*,23*a*; 28*a*, 29*a*; 24*a*,25*a* of the roll pairs 22,23; 28,29; 24,25 which have a concave shape are extended to the edges of the bodies with cylindrical longitudinal segments 22*b*, 23*b*; 28*b*,29*b*; 24*b*,25*b* as shown in FIG. 2. These cylindrical longitudinal segments 22*b*,23*b* and/or 28*b*,29*b* and/or 24*b*,25*b* have diameters 22*c*, 23*c* and/or 28*c*,29*c* and/or 24*c*,25*c* which are at most just slightly smaller than the diameter which the roll body with the standard shape would have near the body edges and preferably still smaller diameters.

Also here the cylindrical longitudinal segments 22*b*,23*b*; 28*b*,29*b*; 24*b*,25*b* of the roll bodies 22*a*,23*a*; 28*a*,29*a*; 24*a*, 25*a* reliably prevent the occurence of linear load peaks between contacting roll body surfaces in definite axial configurations of the neighboring rolls of the roll stand and thus avoid the occurence of critical pressures.

Figure 3:
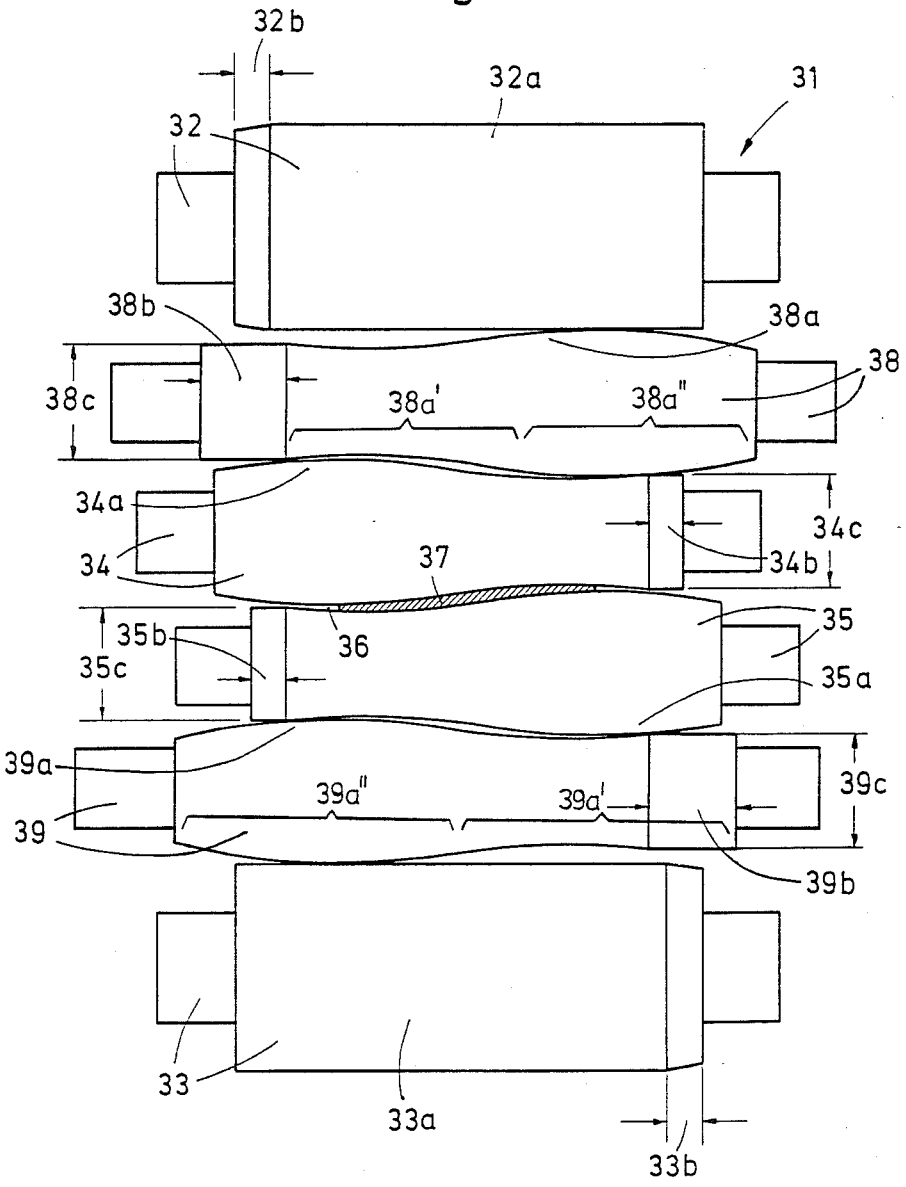
FIG. 3 is a schematic side elevational view of a roll stand having six rolls in a third embodiment as seen in the rolling direction.
Figure 4:
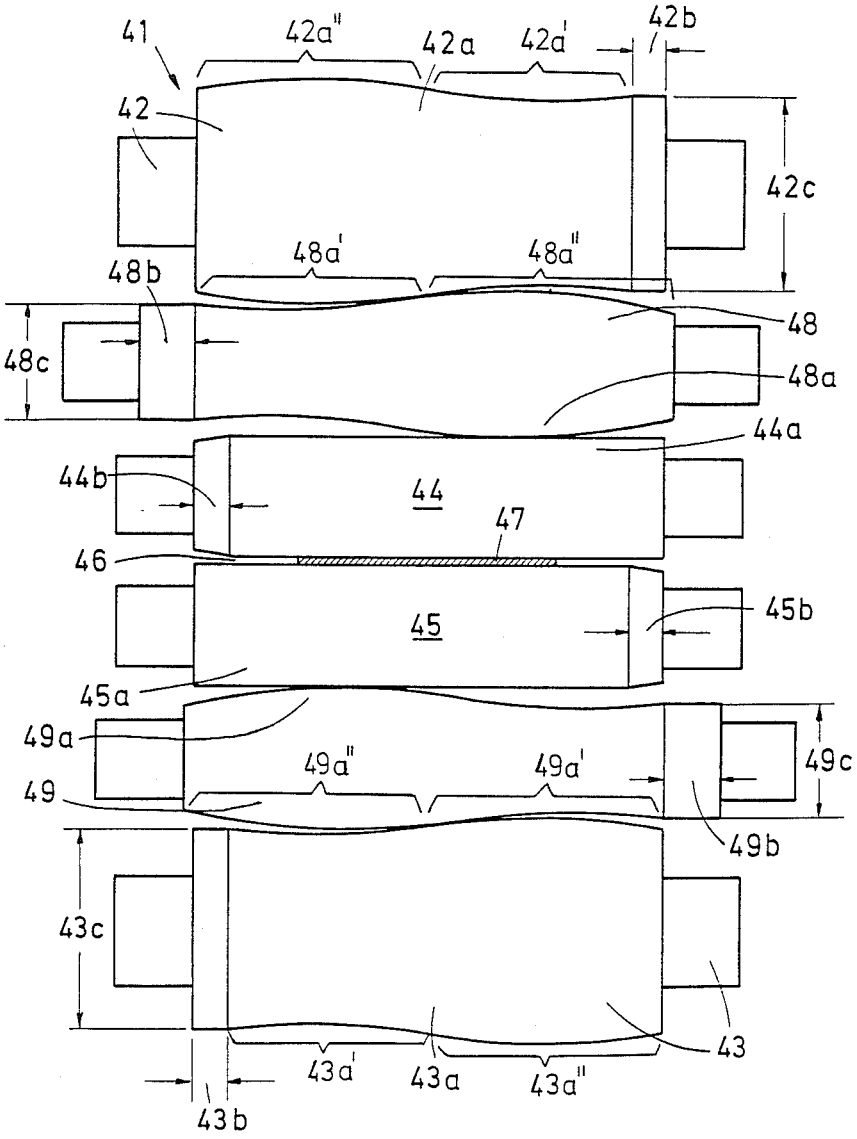
FIG. 4 is a schematic side elevational view of another six-high roll stand according to our invention as seen in the rolling direction.

Other embodiments for a roll stand of a six-high rolling mill which differ from the roll stand of the six-high rolling mill 21 shown in FIG. 2 are shown in FIGS. 3 and 4.

In the six-high rolling mill 31 according to FIG. 3 backup rolls 32 and 33 are used which have a substantially cylindrical shape over their entire length. The working rolls 34 and 35 in contrast have roll bodies 34*a* and 35*a* which are provided with a curved contour over their entire length as are the roll bodies 38*a* and 39*a* of the intermediate rolls 38 and 39 which have a curved contour over their entire length. The curved contour has a convex curvature on one longitudinal segment 38*a*″ or 39*a*″ and a concave longitudinal curvature on the other longitudinal segment 38*a*′ or 39*a*′. Also the structure of the intermediate rolls 38 and 39 and the working rolls 34 and 35 in the rolling mill 31 is such that their body shapes entirely complement each other in the central axial position and thus determine a roll gap 36 for the rolled strip to be worked 37 which instead of having an S-shape curvature has a constant height over its entire width.

In regard to their cylindrically extending end segments 34*b*, 35*b* and/or 38*b* at the ends of their concave contoured longitudinal halves the working rolls 34 and 35 and also the intermediate rolls 38 and 39 are in complete conformity with the working rolls and the intermediate rolls of the rolling mill according to FIG. 2. That is, the diameter 34*c*, 35*c* and/or 38*c*, 39*c* of these longitudinal segments 34*b*, 35*b* and/or 38*b*/39*b* is slightly smaller than the diameter which the roll body 34*a*, 35*a* and/or 38*a*, 39*a* had at the body edges when the standard concave body shape is extended to these edges.

The six-high rolling mill 31 of FIG. 3 differs from the six-high rolling mill 21 according to FIG. 2 not only because of its roll stand backup rolls 32 and 33 with cylindrical roll bodies 32*a* and 33*a*, but also because these cylindrical roll bodies 32*a* and 33*a* at those ends which are adjacent to the concave longitudinal segments 38*a*′ and 39*a*′ of the intermediate rolls 38 and 39 have a longitudinal segment 32*b* and/or 33*b* which is provided with a gently tapered conical contour to the body edges. Also these features contribute during the roll operation with a definite axial configuration of the intermediate rolls 38 and 39 to avoiding linear load peaks at the backup rolls 32 and 33 and thus the resulting critical pressure.

In the six-high rolling mill 41 of FIG. 4 the working rolls 44 and 45 of the working roll pair 44,45 have roll bodies 44*a* and 45*a* with a cylindrical form over their entire length. However at one end each of the working rolls 44 and 45 have a short tapered longitudinal segment 44*b* and/or 45*b* which gently tapers to the body edges. Thus in FIG. 4 it is seen that the tapered longitudinal segments 44*b* and 45*b* having the conically tapered shape are provided on the body ends of both working rolls 44 and 45 directed away from each other.

The roll bodies 42*a* and 43*a* of the backup rolls 42 and 43 as well as the roll bodies 48*a* and 49*a* of the intermediate rolls 48 and 49 are however provided with a curved contour over their entire length whereby these curved shaped rolls have a concave curvature over one longitudinal segment 42*a*', 43*a*', 48*a*' or 49*a*' and a convex curvature over the other longitudinal segment 42*a*'',43*a*'',48*a*'' or 49*a*''. The end which belongs to the concave longitudinal segment 42*a*',43*a*',48*a* ' or 49*a*' extends in a cylindrical longitudinal segment 42*b*, 43*b*, 48*b* or 49*b* to the body edges as shown in FIG. 4. The diameters 42*c*, 43*c* and/or 48*c*,49*c* of the cylindrical extending longitudinal segments 42*b*,43*b* and/or 48*b*, 49*b* is slightly smaller than the diameters which the roll body 42*a*, 43*a* and/or 48*a*, 49*a* at the body edges has when the standard concave body shape is extended to these body edges.

Since in the six-high rolling mill according to FIG. 4 the cylindrically extending longitudinal segments 42*b*, 43*b* of the backup rolls 42 and 43, the cylindrically extending longitudinal segment 48*b*, 49*b* of the intermediate rolls 48 and 49 as well as the conically tapered longitudinal segment 44*b*, 45*b* of the working rolls 44 and 45 have a longitudinal dimension which is equal at least to the maximum permissible displacement for the concerned roll and work in opposition to the occurence of linear load peaks on contact between the roll bodies which can lead to pressing which lies in the critical region.

While in the embodiments shown in FIGS. 1 to 4 the use of roll stands is shown in which the bodies of the roll pairs working together have the same length, it is also possible to use roll stands in which the different roll pairs, also the working roll pairs, have backup roll pairs and if necessary also intermediate roll pairs having differing body lengths. In this case then always that roll pair whose rolls have a curved shape extending over the length of the roll body maintain a body length which is greater than the body length of the adjacent roll with a cylindrical body shape by about twice the available displacement.

In the six roll rolling mill according to FIG. 4 the influencing of the roll gap 46 for the rolled strip to be worked 47 occurs by axially sliding the backup rolls 42 and 43 and/or the intermediate rolls 48 and 49, while the working rolls 44 and 45 can be positioned axially at different positions on their structural members.

In a four-high rolling mill, which—as contrasted with the embodiment according to FIG. 1—is equipped with a backup roll which has a cylindrical shape, while it includes working rolls whose roll bodies have a curved shape along their length, it is particularly advantageous when the body length of the latter in order to double the maximum permissible displacement is greater than the body length of the associated backup roll. The working rolls have cylindrical segments at those body edges which are on the ends of the concave longitudinal segments whose length corresponds at least to the maximum permissible displacement of the concerned working roll.

By this cylindrical extension of the curved body shape of the working roll the otherwise occuring linear load peaks are interrupted in roll operation in as much as the working roll is shiftable axially in a negative direction relative to the backup roll, that is, the body edges of the working roll adjacent the cylindrical extension are set back in contrast to the corresponding body edges of the associated backup rolls.

In order to work against the occurence of linear load peaks with increased pressing in one such four-high rolling mill, when the working rolls are set with positive axial slidablility, it is important to provide the cylindrical body of the backup rolls with a gently tapered conical shape at those body edges which are associated with the concave contour of the working roll body, as seen in FIG. 3 for the six roll rolling mill 31 in which the backup rolls 32 and 33 stand in contact with the intermediate rolls 38 and 39. In case of the four-high rolling mill of this structure the rolls 38 and 39 could then act together as a working roll pair.

We claim:

1. A strip-rolling mill, comprising:

a mill stand;

a pair of upper and lower bottle-shaped working rolls in said mill stand defining a rolling gap through which a strip workpiece is passed, said pair of working rolls being rotatable about respective axes of rotation, said working rolls each having:

a pair of journal pins at opposite ends of each working roll, and a respective roll body between the respective pair of journal pins, each of said bodies being continuously curved from one end of the working roll body over a respective curved portion to a location short of an opposite end of the respective working roll body, the curved portion of each of said working rolls being complementary to but inversely positioned with respect to the curved portion of the other working roll, each curved portion including a convex portion increasing in diameter from the said one end of the respective roll body and then decreasing to an intermediate location along the length of the respective roll body, a concave portion continuously decreasing from said intermediate location and thereafter increasing to said location of the respective roll body short of said opposite end, the maximum diameter of said concave portion being less than the maximum diameter of said convex portion, and a cylindrical portion of constant diameter beginning at said intermediate location of the respective roll body short of the opposite end and extending to said opposite end and lying immediately adjacent to the respective concave portion for reducing linear pressure peaks; and means for shifting said rolls axially in opposite directions by a distance sufficient to effect change in shape of said gap and equal to the axial lengths of said cylindrical portions, each cylindrical portion of a respective roll body axially overlapping the convex portion of the other roll body.

2. The rolling mill defined in claim 1, further comprising at least one pair of generally bottle-shaped backup rolls in said stand and axially shiftable in opposing directions and each bearing upon a respective one of said working rolls, each of said backup rolls having a roll body which is continuously curved from one end of the backup-roll body over a respective curved portion to a location short of an opposite end of the respective backup-roll roll body, the curved portion of each of said backup-roll roll bodies being complementary to but inversely positioned with respect to the curved portion of the respective working roll, each of the bodies of said backup rolls having a cylindrical portion of constant diameter at a respective end thereof.

3. The rolling mill defined in claim 2 wherein said mill further comprises another pair of rolls each engaging a respective one of said bottle-shaped backup rolls and having a roll body of constant diameter.

4. A strip-rolling mill, comprising:

a mill stand;

a pair of upper and lower cylindrical working rolls in said mill stand defining a rolling gap through which a strip workpiece is passed, said pair of working rolls being rotatable about respective axes of rotation;

a pair of intermediate rolls in said stand bearing upon said working rolls;

a pair of backup rolls in said stand bearing upon said intermediate rolls, said intermediate and backup rolls each having:

a pair of journal pins at opposite ends of the respective roll, and a respective roll body between the respective pair of journal pins, each of said bodies being continuously curved from one end of the respective roll body over a respective curved portion to a location short of an opposite end of the respective roll body, the curved portion of each of said working rolls being complementary to but inversely positioned with respect to the curved portion of the other roll of the respective pair, each curved portion including a convex portion increasing in diameter from the said one end of the respective roll body and then decreasing to an intermediate location along the length of the respective roll body, a concave portion continuously decreasing from said intermediate location and thereafter increasing to said location of the respective roll body short of said opposite end, the maximum diameter of said concave portion being less than the maximum diameter of said convex portion, and a cylindrical portion of constant diameter beginning at said intermediate location of the respective roll body short of the opposite end and extending to said opposite end and lying immediately adjacent to the respective concave portion for reducing linear pressure peaks; and means for shifting the rolls of at least one of said pairs of intermediate and backup rolls axially in opposite directions by a distance sufficient to effect change in shape of said gap and equal to the axial lengths of said cylindrical portions, each cylindrical portion of a respective backup roll body axially overlapping the convex portion of the other roll body.

* * * * *